US008881350B2

(12) United States Patent
Pellei

(10) Patent No.: US 8,881,350 B2
(45) Date of Patent: Nov. 11, 2014

(54) CLIP FOR FOLDED FABRICS

(76) Inventor: Robyn Pellei, Charlotte, NC (US)

( * ) Notice: Subject to any disclaimer, the term of this patent is extended or adjusted under 35 U.S.C. 154(b) by 66 days.

(21) Appl. No.: 13/314,717

(22) Filed: Dec. 8, 2011

(65) Prior Publication Data

US 2012/0110799 A1 May 10, 2012

Related U.S. Application Data

(63) Continuation-in-part of application No. 12/550,984, filed on Aug. 31, 2009.

(60) Provisional application No. 61/190,587, filed on Aug. 29, 2008.

(51) Int. Cl.

| | |
|---|---|
| ***F16B 2/22*** | (2006.01) |
| ***A45F 5/04*** | (2006.01) |
| ***A47K 10/02*** | (2006.01) |
| ***A47F 5/00*** | (2006.01) |
| ***A47F 7/14*** | (2006.01) |

(52) U.S. Cl.

CPC ..... *A47F 5/0006* (2013.01); *A47K 10/025* (2013.01); *A47F 7/143* (2013.01)

USPC ..... 24/545; 24/336

(58) Field of Classification Search

CPC ..... A47F 7/143; A47F 5/0006; A47F 10/025

USPC ..... 24/457, 570, 545, 546, 336

See application file for complete search history.

(56) References Cited

U.S. PATENT DOCUMENTS

| | | | | | |
|---|---|---|---|---|---|
| 215,037 | A | * | 5/1879 | Atkinson | 24/457 |
| 303,297 | A | * | 8/1884 | Langford | 24/570 |
| 314,436 | A | | 3/1885 | Crocker | |
| 1,153,490 | A | * | 9/1915 | Harris | 81/15.8 |
| 1,161,559 | A | * | 11/1915 | Weigel | 24/570 |
| 1,209,252 | A | | 12/1916 | Blatt | |
| 1,494,644 | A | * | 5/1924 | Taussig | 40/658 |
| 1,691,213 | A | * | 11/1928 | Smith | 248/310 |
| 1,806,601 | A | * | 5/1931 | Alexander | 24/546 |
| 1,870,172 | A | * | 8/1932 | Buschhaus | 24/129 B |
| 3,305,100 | A | * | 2/1967 | Barbee | 211/120 |
| 4,023,721 | A | | 5/1977 | Erthein | |
| 4,096,655 | A | | 6/1978 | Ullman, Jr. | |
| 4,397,577 | A | * | 8/1983 | Bauer | 402/19 |
| 4,403,366 | A | | 9/1983 | Lucke | |
| 4,514,885 | A | | 5/1985 | Delahousse et al. | |
| 4,536,924 | A | | 8/1985 | Willoughby | |
| 4,839,947 | A | | 6/1989 | Cohen et al. | |
| 4,858,285 | A | | 8/1989 | Dala et al. | |
| 4,901,406 | A | | 2/1990 | Shelby et al. | |
| 5,022,126 | A | | 6/1991 | Davis | |

(Continued)

*Primary Examiner* — Robert J Sandy
*Assistant Examiner* — Louis Mercado
(74) *Attorney, Agent, or Firm* — Additon, Higgins & Pendleton, P.A.

(57) ABSTRACT

A clip for holding folded articles such as towels, fabrics, textiles, nonwoven fabrics, paper, and other sheets of material, includes a single piece construction having contoured braces on opposite ends of a connector. The contoured braces define a hinge portion allowing the braces to move outwardly away from the connector and then resiliently return to a position adjacent the connector. The braces are formed into a shape similar to the English letter S such that one curved portion of the brace is a finger grip and a second curved portion of the brace fits against a folded fabric to hold the fabric within the clip.

1 Claim, 7 Drawing Sheets

(56) References Cited

U.S. PATENT DOCUMENTS

| | | | | |
|---|---|---|---|---|
| 5,318,174 | A | 6/1994 | Zoroufy | |
| 5,350,092 | A | 9/1994 | Hollis | |
| 5,363,538 | A | 11/1994 | Arrendiell et al. | |
| D353,245 | S | 12/1994 | Tucker | |
| 5,388,313 | A | 2/1995 | Cameron | |
| D363,016 | S | 10/1995 | Sipprelle, III et al. | |
| 5,465,458 | A | 11/1995 | Schlager | |
| 5,576,933 | A * | 11/1996 | Campanella et al. | 361/704 |
| 5,611,123 | A | 3/1997 | Prizzi | |
| 5,632,068 | A * | 5/1997 | Riley et al. | 24/326 |
| 5,657,514 | A | 8/1997 | Fabrizio | |
| 5,933,922 | A | 8/1999 | Ochsman | |
| 6,257,422 | B1 | 7/2001 | Rios | |
| 6,547,200 | B2 | 4/2003 | Dilworth | |
| 6,964,342 | B2 | 11/2005 | Wenzler | |
| 2004/0216283 | A1 | 11/2004 | Cassaday | |
| 2008/0277359 | A1 | 11/2008 | St. Martin | |
| 2009/0223027 | A1 * | 9/2009 | Reznar et al. | 24/457 |

* cited by examiner

CLIP FOR FOLDED FABRICS

CROSS REFERENCE TO PRIOR APPLICATIONS

This application is a continuation-in-part of, claims priority to, and incorporates by reference herein co-pending U.S. patent application Ser. No. 12/550,984 filed on Aug. 31, 2009. This application further claims priority to and incorporates by reference herein U.S. Provisional Patent Application Ser. No. 61/190,587 filed on Aug. 29, 2008 and entitled "Towel Clip for Holding Towels in Place."

FIELD OF THE INVENTION

The invention relates to the field of clips for holding articles made of fabric or textiles in a fixed position.

BACKGROUND OF THE INVENTION

Articles made of fabric, whether high end fabrics such as silks or more routinely used terry cloth or jersey cotton, are often used or stored in a folded position. In particular, towels are often used and maintained by folding. Whether folded over a towel rack or gathered within a decorative ring, towels can be most useful when they are maintained in a place and manner that make them convenient to access. Such access often requires textile articles, towels in particular, to be stored or displayed in a public way so that individuals know exactly where they are. Such public display of textile articles has led to individuals using textiles not only for their function but also as decoration. More and more individuals take time to ensure that their textile articles are stored, displayed, or used in the way they are intended but also in a way that looks nice and enhances the decor of the area. A textile article, such as a towel, therefore, requires a certain amount of maintenance to keep the look that the owner would like for the area. For example, towels must be refolded after use or re-hung when accidentally allowed to slip from their holder. The goal of any owner, therefore, is to minimize the maintenance required in keeping textile articles in a desired position. This goal has led to two needs—(i) a device that holds a folded textile article in a desirable position and (ii) a way to decorate the device so that it improves the overall decor of the area in the same way as the textile article.

The prior art sets forth numerous devices for holding folded textile articles. The predominant group of such devices are basic jaw clips. For example, U.S. Pat. No. 5,022,126 (Davis, 1991), shows a one piece molded plastic clamp in a clam shell orientation. The sides of the clam shell have locking members that hold lower legs in a fixed position. Teeth on the lower legs engage the towel to hold it within the clam shell. The Davis '126 device, requires intricate manufacturing of the various regions of the device, particularly the locking members, and the device has a definite industrial look that would not accomplish any aesthetic goal for the device.

U.S. Pat. No. 4,536,924 (Willoughby, 1985) shows another one piece device with a flexible hinge portion connecting flat surface grips. The respective flat surfaces have interlocking male and female members at one end to maintain a grip on a folded article within the flat surfaces. The interlocking members connect in only one position, and the clip of the Willoughby '924 fits only those textile articles of a single width therein.

U.S. Pat. No. 4,023,721 (Erthein, 1977) discloses a clamping hanger having an arm and at least one pair of hinged clamping members integral with the arm. The user squeezes the arm and a lower member provides a bracing surface, allowing the arm to open one side of the hinged clamping members. Again, the clip disclosed in this patent fits only certain articles of a given width. The arm is also a highly stressed component that absorbs all of the force used to open the clip. The arm, therefore, is likely to break after repeated use.

U.S. Pat. No. 4,514,885 (Delahousse 1985) illustrates yet another clip of a clothespin design. Two articulated arms are connected by a spring member such that the arms open and close about a textile article.

Similar to the Delahousse patent, U.S. Pat. No. 4,839,947 (Cohen 1989) shows a clamp formed of a unitary piece of resilient material and has a pair of opposed arms pivoted about an integral hinge member located between jaw and finger grip portions of the arms. The arms define a male and female locking member to hold the clip in place. As in certain other clips discussed above, the Delahousse clip requires precision molding to achieve properly sized and functional male and female locking members. The clip is normally disposed in an open position, which means that in the event of failure of the locking members, the clip is completely non-functional.

Other clipping arrangements used in the textile sector include hangers that have parallel clothespin type clips for hanging textile products. While these kinds of hangers are useful in a retail environment, the clips do little to enhance any aesthetic quality of their surroundings. See U.S. Pat. No. 5,350,092 (Hollis 1994) and U.S. Pat. No. 6,964,342 (Wenzier 2005).

Towels and clips for arranging them have been the subject of numerous patenting efforts over the years. For example, certain towel holders include weighted extensions that hang over a towel rack to hold the towels in place. See U.S. Pat. No. 5,465,458 (Schlager 1995) and U.S. Patent Application Publication No. 20080277359 (St. Martin 2008). U.S. Pat. No. 6,257,422 (Rios 2001) shows a v-shaped holder that can be mounted flush against a flat surface, such as a wall or a cabinet. The v-shaped member is biased to close onto itself, and an interior, upwardly extending leg, jutting outwardly from one leg of the "v," presses into the back section of the v-shaped member from the inside. The v-shaped member can be forced to open, a textile or other article pushed into the open v-shaped member, and the clip will hold the textile article therein.

Although not focused on any aesthetic quality, other patents show towel clips for attaching to the person of an individual carrying a towel. U.S. Pat. No. 4,403,366 (Lucke 1983) shows a clip that slides onto a belt, pants, or any personal item capable of receiving one end of the clip. U.S. Pat. No. 4,901,406 (Shelby 1990) shows a standard clasp for attaching to a belt loop at one end and attaching a jaw clip mechanism to the other end. The jaw clip holds a personal towel for working out in a gym, playing golf, or engaging in any activity in which a towel is useful on one's person.

Towel holders of single piece construction have proven useful in certain rounded designs. The round design has an interesting and appealing shape but is apparently predominantly useful in wrapping a towel about a beach chair. See U.S. Pat. No. 5,611,123 (Prizzi 1997)(showing a towel holder consisting of a plastic tube split lengthwise into two halves that fit about a back bar of a beach chair); see also, United States Design Patent No. D363,016 (Sipprelle III).

Overall, the prior art shows a need for a new kind of clip that allows for variously sized textile articles, particularly towels, to be maintained in a defined folded position. The clip should also allow for creativity in enhancing the aesthetics of the area in which the towel is stored and used.

SUMMARY OF THE INVENTION

The invention is a clip for holding textiles in a folded position. The clip is made of a flexible and resilient polymeric material, such as a plastic that has memory to retain its original shape. The clip is characterized in part by a pair of braces having first and second ends. The braces define an opening between the braces. The braces are connected by a cross member attached to the braces at a first end. A flattened member, referred to herein as a tongue also extends from the cross member between the braces and toward the end of the braces opposite the cross member. The cross member biases the position of the tongue between the braces such that the space between the tongue and the braces is in a "normally closed" position (i.e., either the braces or the tongue must move away from the other to fit an article between the braces and the tongue).

In another embodiment, the invention is a clipping system that further includes a decorative component. The cross member and the tongue of each clip define holes in either or both of the tongue and cross member. A decorative accessory (21) can be attached to the clip via the holes, or two clips can be used in conjunction across a single piece of fabric to attach a ribbon, a string of beads, or another laterally disposed decorative element (20) across the fabric. A button or pin can be used to penetrate through the decorative element (20) and engage an appropriately defined hole in each clip.

In yet another embodiment, the invention is a clipping system for folded fabrics utilizing a single piece body having integral portions including braces at opposite ends of a connector. The braces are sufficiently resilient to receive a folded fabric therein and thereby hold the folded fabric against the connecter such that the connector extends across a side of the folded fabric opposite the braces. The connector serves as decorative band across the folded fabric.

DETAILED DESCRIPTION

Figure 1:
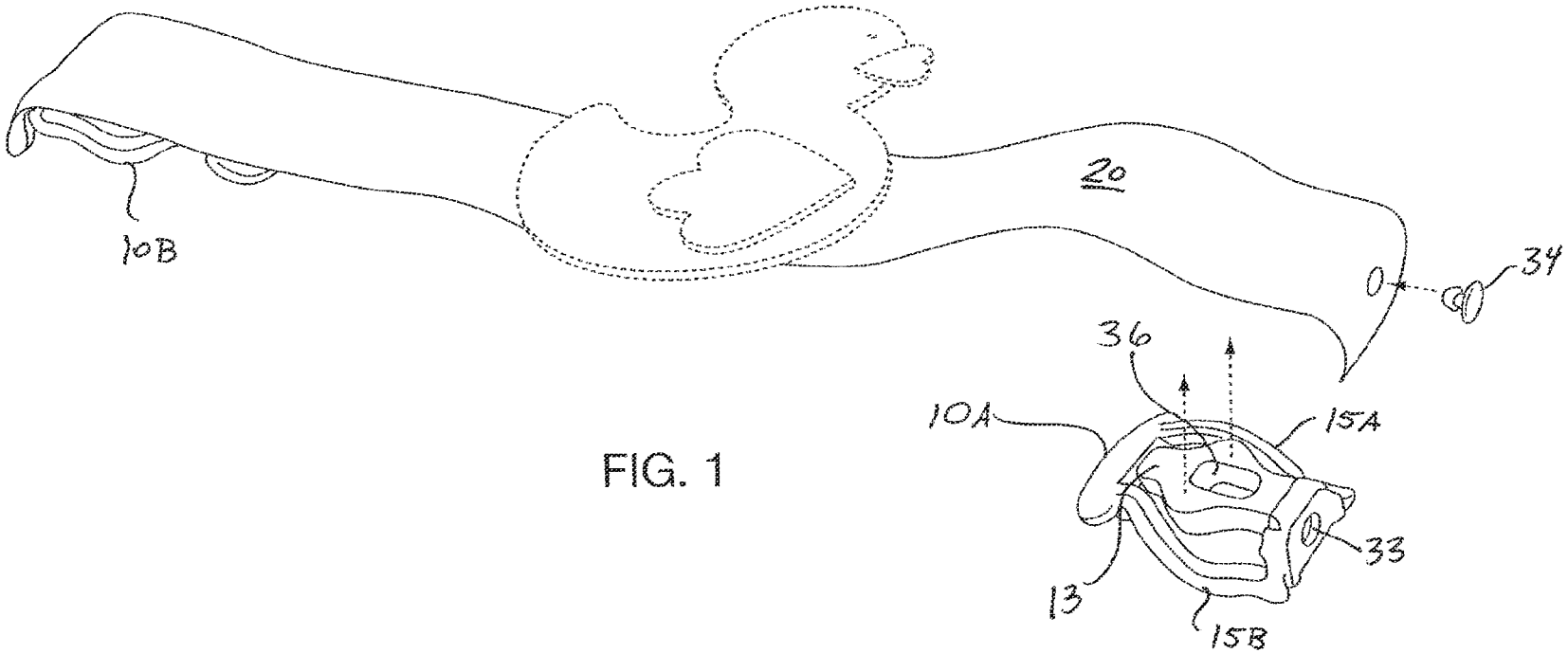
FIG. 1 is a schematic view of a decorative element connected to a pair of clips for holding textiles according to this invention.

The clip (10) according to this invention addresses an issue not seen before in clips of the prior art—making textiles and other folded fabrics (30) maintain a folded position, look nice, and not show too much hardware associated with the clip (10). The clip (10) is adapted to hold the sides of a folded fabric (30) together. For purposes herein, a folded fabric is a generic term that encompasses any material that can be folded, such as textile fabrics, non-woven fabrics, papers, towels dish cloths, and the like. The term "folded fabric," therefore, is not limiting of the invention. Similarly, the term "textiles" may be used in this document in its broadest sense and does not limit the kinds of folded articles or fabrics that may benefit from the clip of this invention.

The clip (10) according to this invention can be used as a single piece of equipment for holding a single accessory (21) via a tongue (13) on the clip (10). Alternatively, the clip (10) can be part of a clipping system using two clips (10A, 10B) on either side of a folded article. With two clips attached to the article, a longer, transverse decorative element (20) can be held in place at each of its ends. In this case, the decorative element can be a ribbon, a string of beads, a line of connected jewels, or any decoration that extends across a folded fabric (30). The clip (10) and the associated clipping system (10A, 10B) allow for a folded fabric such as a towel to be secured to maintain its placement and its folded position. The decorative element, of course, adds an opportunity for aesthetic enhancement of the surrounding area. See FIG. 1.

Figure 2:
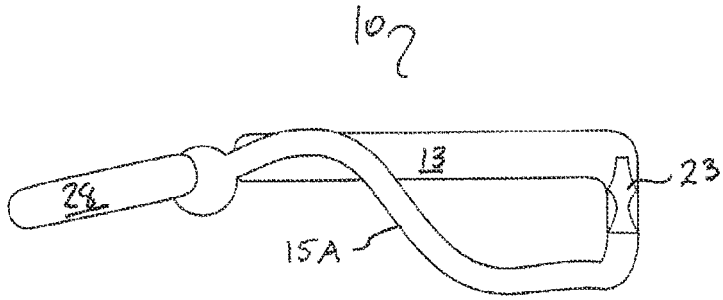
FIG. 2 is a side view of one clip according to this invention, the clip being in its normally closed position.

FIG. 1 shows certain components of the clip (10) that make it very useful. The clip (10) includes a pair of braces (15A, 15B) defining a space there between. The braces (15A, 15B) have first and second ends. A cross member (17) connects the first ends of each brace (15). A tongue, or substantially flat portion, extends from the cross member toward second ends of the braces (15A, 15B). FIG. 2 shows the clip (10) from a side view. The braces (15A, 15B) may be rounded or contoured for more diversity in the size of the gap formed upon opening the clip (10).

The overall clip (10) is made of a resilient and deformation resistance material, such as a soft plastic or other polymer. The material allows the clip to be opened and closed, but the material of the clip (10) is flexible enough to maintain a "normally closed" position absent a force separating the tongue (13) and the braces (15A, 15B). In this regard, the cross member (17) biases the tongue (13) such that the tongue (13) rests between the braces. The tongue, therefore, is a flap of sorts that points into the opening formed by the braces (15A, 15B) unless pulled away from the braces by an outside and opposite force. The resilience of the material making up the clip (10) allows for many different sizes of gaps formed between the tongue (13) and the braces (15A, 15B). In other words, the tongue (13) and the braces (15A, 15B) will move themselves directly adjacent a folded fabric (30) moved into the gap (40) of the clips (10A, 10B). In this regard, the clip (10) of this invention does not require locking members or springs or other elements to fit many different thicknesses of the folded fabric (30).

Figure 3:
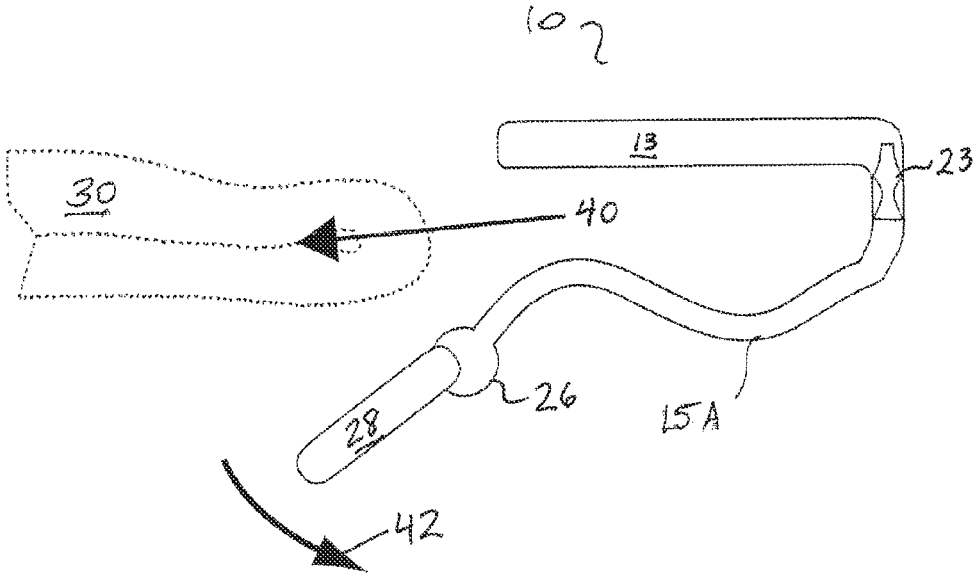
FIG. 3 is a side view of the clip according to FIG. 2, the clip being opened to form a space between a tongue and a pair of braces.
Figure 4:
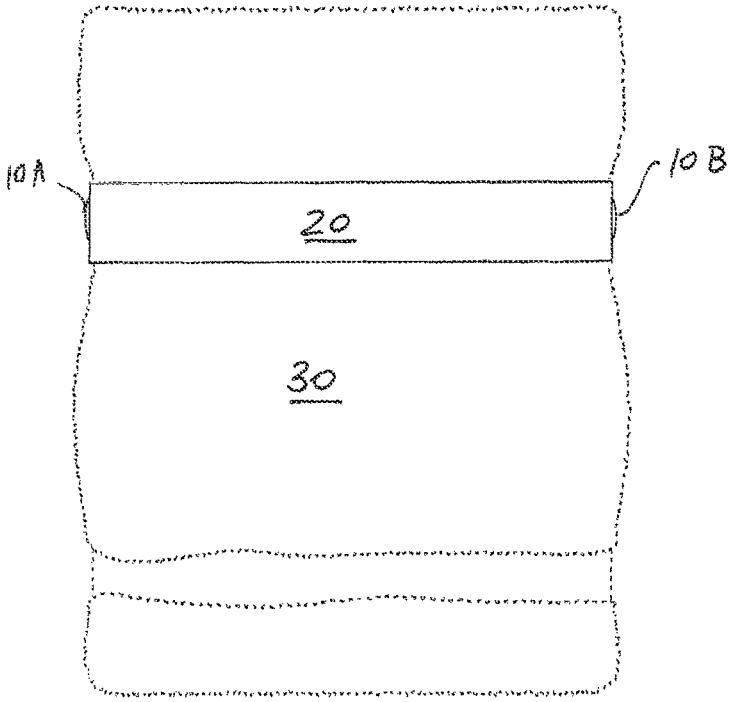
FIG. 4 is a front view of a folded fabric, such as a towel, having clips in place on each side and decorative element extending across the fabric.
Figure 5:
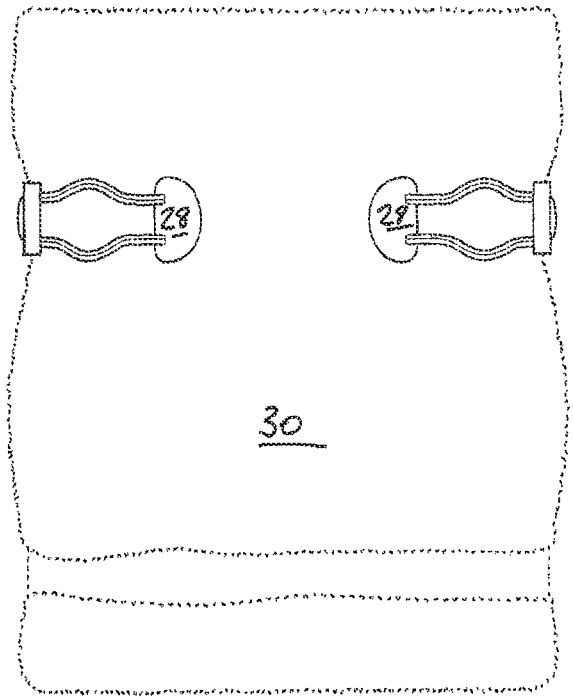
FIG. 5 is a back view of the folded fabric of FIG. 4, showing the braces extending along a portion of the folded fabric, the braces connected by a base member on each clip.

FIG. 3 shows a clip (10), according to this invention, that has been subject to an opening force (42) to form the gap (40) between the tongue (13) and the braces (15A, 15B). The arrow of FIG. 3 shows that a side of the folded fabric (30) slides into the gap (30). The tongue (13) and the braces (15A, 15B) will squeeze against opposite portions of the folded fabric. As shown in FIGS. 2 and 3, certain areas of the clip can include reinforcement members (23A) along regions of the clip (10) that face the most stress in light of opening force (42). The clip (10) optionally includes a base member (28) that connects ends of the braces opposite the cross member (17). As shown in FIG. 5, cross member (17) adds a smooth surface for engaging the folded fabric (30) to prevent any unnecessary indentations or damage to the fabric. The braces may optionally include a rounded region (26) for additional decoration and for a tighter fit against thinner fabrics.

Each clip (10) is adapted for holding a decoration thereon by holes defined within the body of the clips (10). In one embodiment, the cross member (17) defines a button hole (33) for receiving an associated button (34) or post. The button (34) slides through a slit in the decorative element (20) and engages the button hole (33) in the cross member (17) of the clip (10). By having clips (10A, 10B) at both sides of the folded fabric, an elongated decorative element (20) stretches across the folded fabric. The decorative element (20) can be of any type—beads, jewels, metal strips, fabrics, ribbons, and the like.

The clip (10) also allows for attaching single accessories (buttons, snaps, individual items) to the tongue (13) via a groove (36) in the tongue (13). The holes and grooves in each clip (10) allow for more individual accessories that do not stretch across from one end to another. Instead, individual accessories are mounted independently on either side of the folded fabric. The clip (10) further allows for attaching a strap (not shown) to the clip by either of the openings. This strap can be used by retailers for displaying folded articles hanging by the strap.

The clip (10) is resilient due to the material from which it is made and by the fact that the clip is of a single piece construction with fewer seams or connectors to fail during use.

Figure 6:
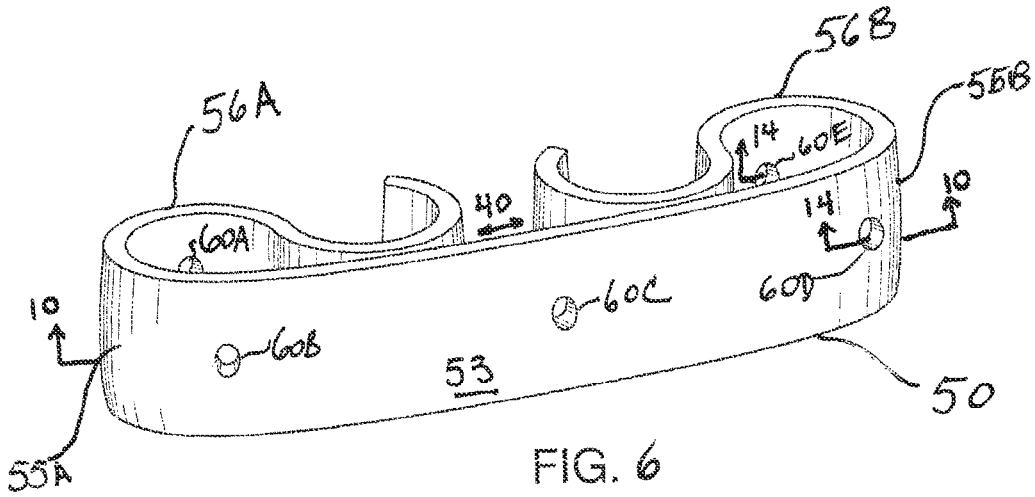
FIG. 6 is a front perspective view of a clip according to one embodiment of the invention and shows a single piece construction.
Figure 7:
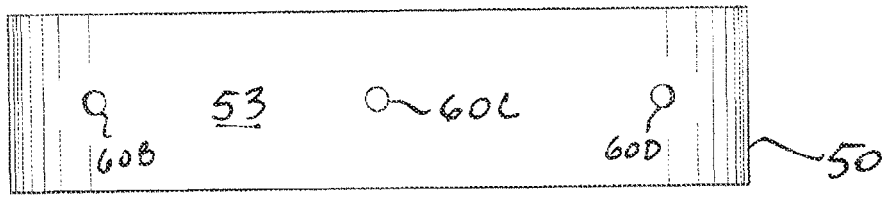
FIG. 7 is a front plan view of the clip of FIG. 6.

A different embodiment of a clip (50) according to this invention is shown in FIGS. 6-14. As shown in FIG. 6, a clip (50) may incorporate braces (56A, 56B) in a single piece body constructed by incorporating the braces as integral portions of the clip (50). The term "integral" as used herein includes, but is not limited to, embodiments in which the braces are formed within the single piece construction with no defined separation between the two (i.e., there is continuity of construction between the single piece body and the braces). In the embodiment of FIG. 6, the braces (56A, 56B) are positioned at opposite ends of the clip (50) and are connected by an elongated connector (53). In one embodiment, the clip (50) is a single piece device formed of a continuous strip such that there is no noticeable break between the connector (53) and the braces (56A, 56B) at each end of the connector. In this embodiment, the clip (50) may be formed in a single piece mold (e.g., by injection molding or similar technology).

Figure 8:
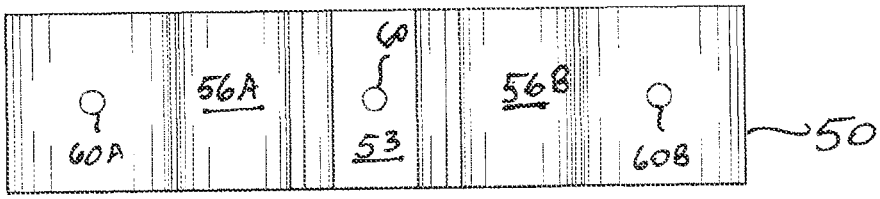
FIG. 8 is a rear plan view of the clip of FIG. 6.
Figure 9:
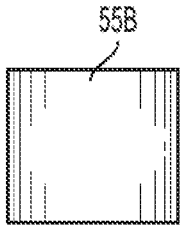
FIG. 9 is a side plan view of the clip of FIG. 6.

As shown in FIGS. 7-10, the clip (50) has a side intended for facing outward when in use (i.e., a front face depicted in FIG. 7) with the braces (56A, 56B) on a rear side shown in FIG. 8. Each side of the clip (50) will have an edge (55A, 55B) shown as curved edges in FIG. 9. The respective edges (55A, 55B) define hinges allowing the clip to open for inserting a folded fabric (30). The edges (55A, 55B) are continuous with and integral to the overall single piece construction of the clip (50), but are sufficiently separable to allow the folded fabric (30) to fit between the braces (56A, 56B) and the connector (53). In one embodiment, the edges (55A, 55B) comprise a curved portion that is sufficiently resilient to widen the distance, or gap (40), between the braces and the connector such that a folded fabric fits therein.

FIG. 10 shows a cross section of the clip (50) and is useful for identifying the front face (70) of the connector (53) and a back side (71) of the connector (53). In use, a folded fabric (30) fits within the gap (40) shown in FIG. 10 as extending between the braces (56A, 56B) and the back side (71) of the connector (53). The gap (40) widens when the edges of the clip (55A, 55B) are separated, or stretched to an open position.

Figure 10A:
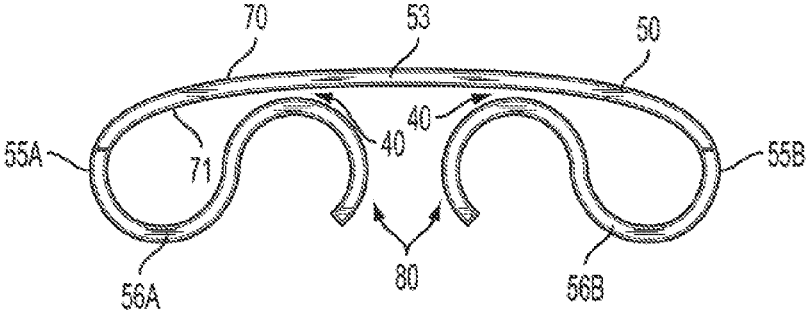
FIG. 10A and 10B are cross section view of the clip of FIG. 6.
Figure 10B:
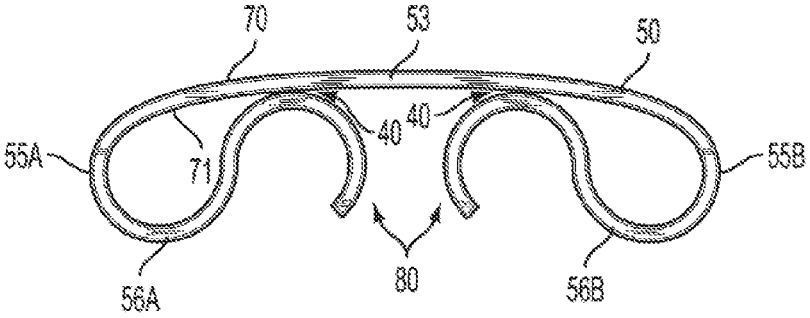
Figure 11:
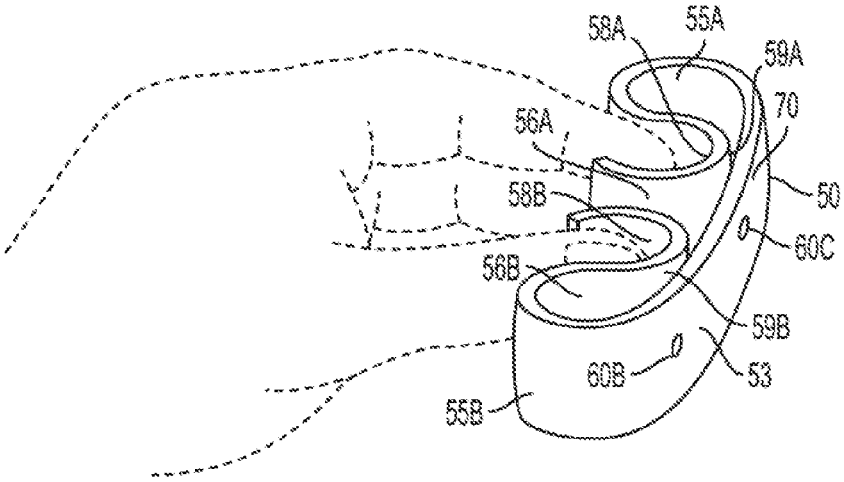
FIG. 11 is a perspective view of the clip of FIG. 6 and shows a user gripping the rear of the clip with the front facing outward away from the user's hand.

FIGS. 10A and 10B also show that the braces (56A, 56B) may be formed as contoured ends 80 of a continuous strip defining the clip (50). The contoured ends define the braces and may be shaped into the form of the English letter "S." A first curved portion (58A, 58B) of the "S" shape defines a finger grip (58) as shown in FIG. 11. Each brace has a respective grip that allows the user to move the brace (56A, 56B) away from the connector (53) to fit a folded fabric therein. Adjacent the finger grip (58), the braces each include a second curved portion (59A, 59B) that fits against a folded fabric held within the clip or presses against the connector (53) when no folded fabric is placed therein.

The clip may be contoured as shown in the Figures, or it may have sharper corners in other designs. The shape of the clip (50) may vary according to the use at hand and the taste of the user. As shown herein, the braces (56A, 56B) may be rounded or contoured for more diversity in the size of the gap (40) formed upon opening the clip (50). The overall clip (50) is made of a resilient and deformation resistance material, such as a soft plastic or other polymer. The material allows the clip to be opened and closed, but the material of the clip (50) is flexible enough to maintain a "normally closed" position absent a force separating the braces (56A, 56B) from the connector (53) along the edges (55A, 55B). The resilience of the material making up the clip (50) allows for many different sizes of gaps formed between the braces (56A, 56B) and the connector (53). In other words, the braces (56A, 56B) will move themselves directly adjacent a folded fabric (30) moved into the gap (40) of the clip (50). In this regard, the clip (50) of this invention does not require locking members or springs or other elements to fit many different thicknesses of the folded fabric (30).

Figure 13:
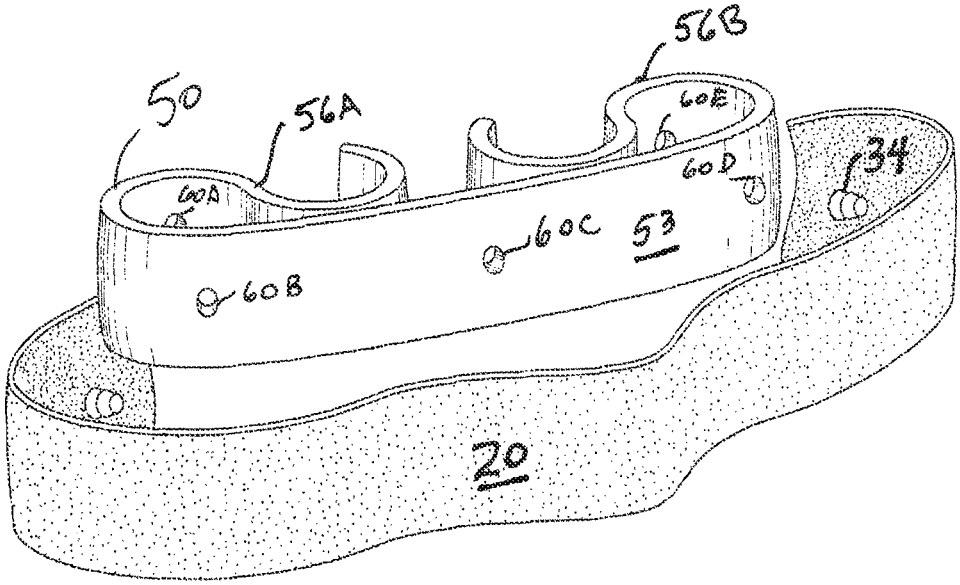
FIG. 13 is a front perspective view of the clip of FIG. 6 with a decorative element in exploded view for attaching to the clip.
Figure 14:
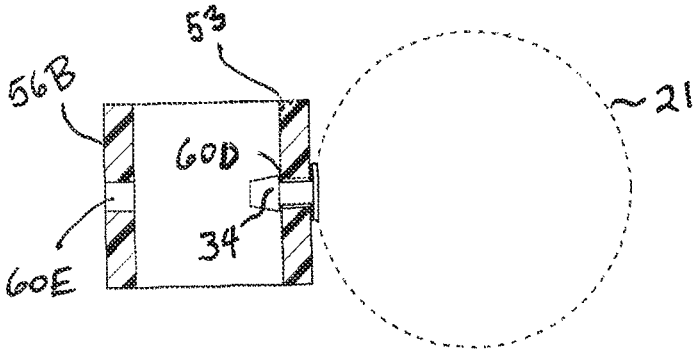
FIG. 14 is a cross section view of the clip of FIG. 6 and shows a decorative item connected to a front side opening.

The clip (50) defines holes, or openings (60A-60E) allowing for attaching decorative elements (20) or accessories (21). FIG. 13 shows that a decorative element, in this case an elongated strip of decorated fabric, may be attached to the clip (50) by inserting buttons (34) associated with the decorative element (20) into the holes (60A-60E) of the clip (50). The buttons (34) hold the decorative element (20) onto the clip (50) and may be affixed permanently to the decorative element (20) or may be removable (e.g., by inserting the buttons through a slit in the decorative element and then into the hole on the clip). A similar mechanism is available to attach an individual accessory (21) to a single hole (60D) as shown in FIG. 14. Accordingly, the clip (50) allows for either a decorative band or strip of fabric to cover the entire clip (50) or multiple accessories (21) to be attached at individual holes (60) defined by the clip (50).

Figure 12:
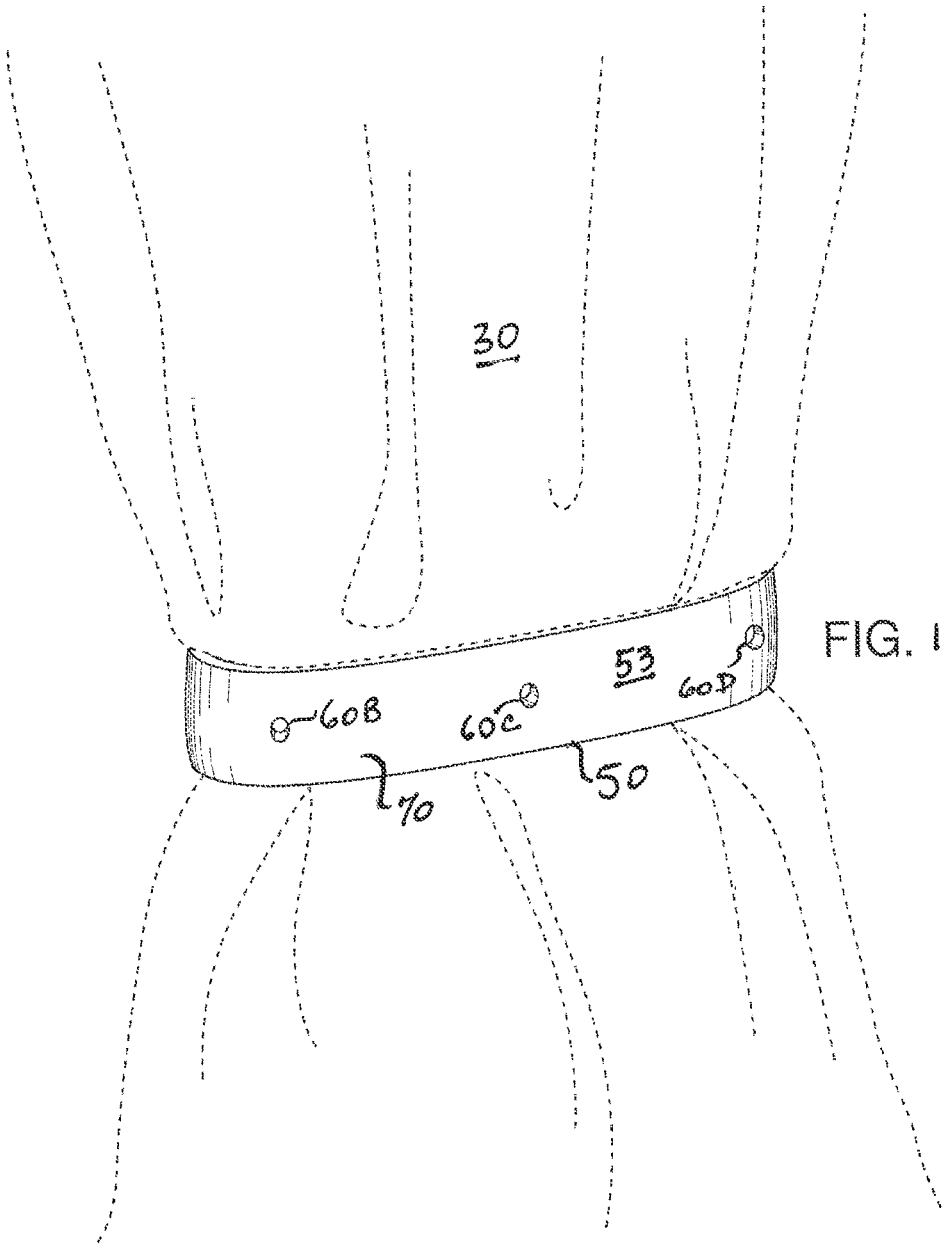
FIG. 12 is a front perspective view of the clip of FIG. 6 installed to hold a folded fabric.

In the embodiment of FIG. 12, the clip (50) is sufficiently decorative to be installed with neither decorative elements (20) nor accessories (21) attached to the clip (50). In this case, the clip (50) may be formed in numerous colors or incorporate designs within the clip by techniques such as engraving, painting, molding, stickers, and the like.

In the specification and drawings, typical embodiments of the invention have been disclosed and, although specific terms have been employed, they have been used in a generic and descriptive sense only and not for purposes of limitation. Different kinds of materials and decorative elements may be substituted for the parts disclosed herein and still fall within the ambit of the invention. The invention is further set forth in the claims below.

The invention claimed is:

1. A clip comprising a connector having contoured ends that are sufficiently resilient to be moved away from said connector and fitting a folded fabric within the clip, said contoured ends compressing against said connector when said folded fabric is removed from said clip;

wherein said connector defines holes for connecting decorative elements or decorative accessories to the clip;

wherein said contoured ends are substantially shaped into a form of an English letter S;

wherein a first section of said contoured end is a grip for moving said contoured end away from said connector to fit a folded fabric within said clip; and wherein said contoured edges define holes for connecting decorative elements or decorative accessories to the clip.

* * * * *